US005515913A

United States Patent [19]

Sanz

[11] Patent Number: 5,515,913

[45] Date of Patent: May 14, 1996

[54] ANODICALLY PROTECTED HEAT EXCHANGER

[76] Inventor: Delio Sanz, 34 Mellowood Drive, Willowdale, Ontario, Canada, M2L 2E3

[21] Appl. No.: 300,365

[22] Filed: Sep. 2, 1994

Related U.S. Application Data

[63] Continuation of Ser. No. 4,446, Jan. 14, 1993.

[51] Int. Cl.[6] ..... F28F 19/00

[52] U.S. Cl. ..... 165/134.1; 204/196

[58] Field of Search ..... 165/134.1; 204/147, 204/196

[56] References Cited

U.S. PATENT DOCUMENTS

| | | | |
|---|---|---|---|
| 1,020,480 | 3/1912 | Cumberland | 204/196 |
| 4,437,957 | 3/1984 | Freeman | 204/147 |
| 4,588,022 | 5/1986 | Sanz | 165/1 |
| 4,689,127 | 8/1987 | McAlister | 204/147 |

FOREIGN PATENT DOCUMENTS

| | | | |
|---|---|---|---|
| 2244331 | 3/1974 | Germany | 165/134.1 |

*Primary Examiner*—Allen J. Flanigan
*Attorney, Agent, or Firm*—Polster, Lieder, Woodruff & Lucchesi

[57] ABSTRACT

An anodically protected shell and tube heat exchanger for exchange of heat between a heat transfer fluid in the tubes and a corrosive liquid in the shell. A first anodic protection circuit at one end of the shell comprises a first elongate cathode that extends parallel to the tubes, is spaced laterally therefrom, and is in electrical contact with the corrosive liquid in a first zone between the tube sheet at the one end and a location spaced from the tube sheet at the other end. A second anodic protection circuit at the other end of the shell comprises a second elongate cathode that extends parallel to the tubes, is spaced laterally therefrom, and is in electrical contact with the corrosive liquid in a second zone between the tube sheet at the other end of the shell and a location spaced from the tube sheet at the one end. The conductive surface of the second cathode in contact with the corrosive liquid is spaced sufficiently from the conductive surface of the first cathode in contact with the corrosive liquid so that the operations of the anodic protection circuits do not interfere with one another.

3 Claims, 3 Drawing Sheets

ANODICALLY PROTECTED HEAT EXCHANGER

This is a continuation application of copending application Ser. No. 08/004,446, filed on Jan. 14, 1993.

BACKGROUND OF THE INVENTION

This invention relates to an anodically protected heat exchanger, and more particularly to a heat exchanger which has a corrosive liquid on the shell side and is provided with an improved anodic protection system that assures control of voltage within the passive range along the exterior surfaces of the tubes.

Electrical currents are used conventionally in industry to protect metals against corrosion, either by the long known method of cathodic protection or, more recently, by the creation of a protective anodic film, in which case the technique is known as anodic protection. This invention is concerned with improved anodic protection for shell and tube heat exchangers and more particularly with protection of the exterior surfaces of the tubes in exchangers wherein a corrosive liquid is passed through the shell side and the heat transfer fluid passes through the tubes.

In conventional anodic protection systems for such heat exchangers, cathodes are typically positioned at various locations within the heat exchanger shell, or in the inlet and exist nozzles for the corrosive liquid, and all of these cathodes are electrically connected to the negative terminal of a power source in a single anodic protection circuit. Each cathode is of limited dimension and effectively provides protection in a local zone surrounding that cathode. To provide protection for a large shell and tube heat exchanger, these so-called pin cathodes must be positioned at a substantial number of points along the length of the exchanger in order to provide protection of the tubes throughout the exchanger.

Where there is a substantial longitudinal temperature gradient along the shell, the potential at the cathode required to maintain the tube surfaces in the passive potential range may vary significantly from one end of the exchanger to the other. Where the shell side fluid is a highly corrosive liquid, such as sulfuric acid, it may be difficult to control the cathode potential at a level which assures control of the tube surface potential within the passive range along the entire length of the exchanger.

Provision of pin cathodes in numerus locations along the shell is also expensive and multiplies the points at which corrosive liquid may potentially leak from the system. The disadvantages of multiple pin electrodes can be minimized by use of elongate cathodes that extend parallel to the tubes from one tube sheet to the other. However, the voltage drop along such a lengthy cathode may cause the tube surfaces at one end of the exchanger to stray outside the passive range in order to control tubes at the other end within that range. For an aggressive acid, such as sulfuric acid, the passive potential range is generally narrower at high temperature than it is at low temperature, requiring especially careful control of the potential in the hot end of the heat exchanger. As a consequence, the potential may readily stray into the transpassive range at the cold end. Rapid tube failure can result.

U.S. Pat. No. 4,588,022 discloses an anodically protected heat exchanger in which a negative potential is provided to both ends of a cathode that extends from one end of the exchanger to the other. In order to control the potential profile on the tubes along the entire length of the exchanger within the passive range, a variable resistor is provided in the electrical connection between the negative terminal of the direct current power source and the cathode at the cold end of the exchanger. Since the hot end typically draws more current, the voltage drop in the resistor allows the potential at the negative terminal of the power source to be controlled at a level sufficient to establish a passive voltage on the exterior surfaces of the tubes in the hot end without straying into the transpassive range in the cold end.

According to U.S. Pat. No. 4,588,022, the cathode may also be encased in a Teflon sheath which prevents grounding of the cathode on the metal parts of the exchanger and avoids transpassivity on the baffles and tube sheet in close proximity to the cathode. Holes in the Teflon sheet allow for passage of current between the metal parts to be protected and the portions of the cathode rod sufficiently distant from tube, tube sheet, and baffle surfaces to avoid grounding or transpassivity.

In an alternative embodiment, the '022 patent describes a system in which an independent power source is attached to each end of the cathode, each power source having an independent controller.

Although the anodic protection system of the '022 patent provides advantages over systems which utilize a multiplicity of pin cathodes, control of the voltage profile along the length of the heat exchanger is unavoidably limited by exposure of a single cathode to the corrosive liquid system along the entire length of the exchanger. Where the exchanger is of substantial length and/or the temperature differential from end of the exchanger to the other is very large, the operation of the variable resistor may not be effective to control the voltage profile so that it nowhere strays outside the passive range. With colder acid conditions wherein current requirements and voltage drop through the resistor falls toward zero, and the resistor and the resistivity of the cathode lose their regulatory effect. Even where independent power sources are used, it may not always be feasible to control both ends of a single cathode at voltages which preserve the voltage within the passive range along the entire length of the cathode. Under low current conditions, the resistivity of the cathode is inadequate to prevent the voltage applied at the hot end of the cathode from prevailing along the entire length of the cathode.

In an effort to facilitate independent control of voltage at the respective ends of the exchanger, the '022 patent uses a cathode having a defined range of resistivity. The patent expressly avoids the use of copper core cathodes, for example, so that the cold end of the exchanger is not shunted to the same potential as the hot end. However, this very resistivity necessarily creates a significant voltage gradient, which in a long exchanger may cause the null point (i.e., the point of minimum voltage) to remain in the active range if the voltage at that point of the exchanger is inadequate Lo form the passive film.

SUMMARY OF THE INVENTION

Among the several objects of the present invention, therefore, may be noted the provision of an improved anodic protection system for the exterior surfaces of tubes in a shell and tube heat exchanger having a corrosive liquid flowing through the shell side; the provision of such a system in which the hot end and the cold end voltage may be independently controlled; the provision of such a system which is effective for heat exchangers of substantial length; the provision of such a system that is effective for heat exchangers wherein a large temperature difference prevails between the hot end and the cold end of the shell; the provision of such a system in which the effect of voltage drop through the cathode does not result in a voltage profile extending outside the passive range at any point in the exchanger; the provision of such a system which is effective for heating or cooling sulfuric acid at high temperature; and, in particular, the provision of the system which is effective for use in sulfuric acid coolers for absorption acid as produced in contact sulfuric acid manufacturing process.

Briefly, therefore, the present invention is directed to an anodically protected heat exchanger for a corrosive liquid. The heat exchanger has an elongate shell and a plurality of elongate Lubes extending longitudinally within the shell and constructed of a metal which is passive to corrosion by the liquid within a range of positive voltage at the metal surface. The corrosive liquid flows through the shell side of the exchanger and a heat transfer fluid flows within the tubes for exchange of heat with the corrosive liquid. Baffle means within the shell direct the flow of the corrosive liquid in a path within the shell such that there is a longitudinal temperature gradient in the corrosive liquid on the shell side of the exchanger, the fluid nearest one end of the elongate shell being at a higher temperature than the fluid at the other end of the shell. The exchanger comprises an improved anodic protection system for protecting the exterior surfaces of the tubes against corrosion by the corrosive liquid.

The anodic protection system comprises a first anodic protection circuit comprising a first direct current voltage source, means for electrical communication between the positive terminal of the first source and the tubes at one end of the shell, and a first elongate cathode contained within the shell. The first cathode extends parallel to the tubes and is spaced laterally therefrom. The cathode is in electrical contact with the corrosive liquid in a first zone of the shell between the tube sheet at said one end of the shell and a location spaced from the tube sheet at the other end of the shell. The first anodic protection system further comprises means for electrical communication between the first cathode and the negative terminal of the first voltage source, means for detecting the voltage at the exterior surface of tubes within the first zone, and means for controlling the voltage output of the first power source in response to the first detecting means so that the voltage at the exterior surfaces of the tubes in the first zone is controlled at a voltage at which the metal is passive to corrosion by the liquid.

The exchanger further comprises a second anodic protection circuit which comprises a second direct current voltage source, means for electrical communication between the positive terminal of the second source and the tubes at the end of the shell opposite said first end, and a second elongate cathode contained within the shell. The second cathode extends parallel to the tubes and is spaced laterally therefrom. The second cathode is in electrical contact with the corrosive liquid in a second zone of the shell between the tube sheet at said other end of the shell and a location spaced from the tube sheet at said one end of the shell. The second anodic protection circuit further comprises means for electrical communication between the second cathode and the negative terminal of the second voltage source, means for detecting the voltage at the exterior surfaces of the tubes within the second zone, and means for controlling the voltage output of the second power source in response to the second means for detecting the voltage at the exterior surfaces within the second zone so that the voltage at the exterior surfaces of the tubes in the second zone is controlled at a voltage at which the metal is passive to corrosion by the liquid.

The conductive surface of the second cathode in contact with the corrosive liquid is spaced sufficiently from the conductive surface of the first cathode in contact with the corrosive liquid so that the operations of the circuits do not interfere with one another.

Other objects and features will be in part apparent and in part pointed hereinafter.

BRIEF DESCRIPTION OF THE DRAWINGS

Corresponding reference characters indicate corresponding parts in the several views of the drawings.

DESCRIPTION OF THE PREFERRED EMBODIMENT

In accordance with the present invention, it has been found that, by use of independent elongate cathodes for protection of the exterior surfaces of the tubes in the hot end and the cold end, respectively, of the exchanger, substantially enhanced and reliable anodic protection may be achieved in a shell and tube heat exchanger in which corrosive liquid flows through the shell. The use of elongate cathodes avoids the cost and leakage problems associated with pin cathodes and further provides the advantage of the '022 patent in establishing an anodic protection circuit substantially along the entire length of the exchanger. Thus, the entire voltage profile along the length of the exchanger may be maintained within the passive range even for heat exchangers of very substantial length and/or for exchangers in which the temperature differential between the hot end and the cold end is very large on the corrosive liquid, i.e., shell side, of the exchanger. By use of independent voltage sources, the anodic protection system of this invention does not rely on a variable resistor whose effectiveness may be obviated during periods of low current flow. Because not only the power sources, but also the cathodes, are independent of one another, the system of the invention may advantageously utilize cathodes of higher electrical conductivity. By this means, the system eliminates the substantial voltage gradients that may otherwise force the voltage to stray above the passive range ill one section of the exchanger in order to avoid straying below the range in another portion of the exchanger remote from the first.

Figure 1:
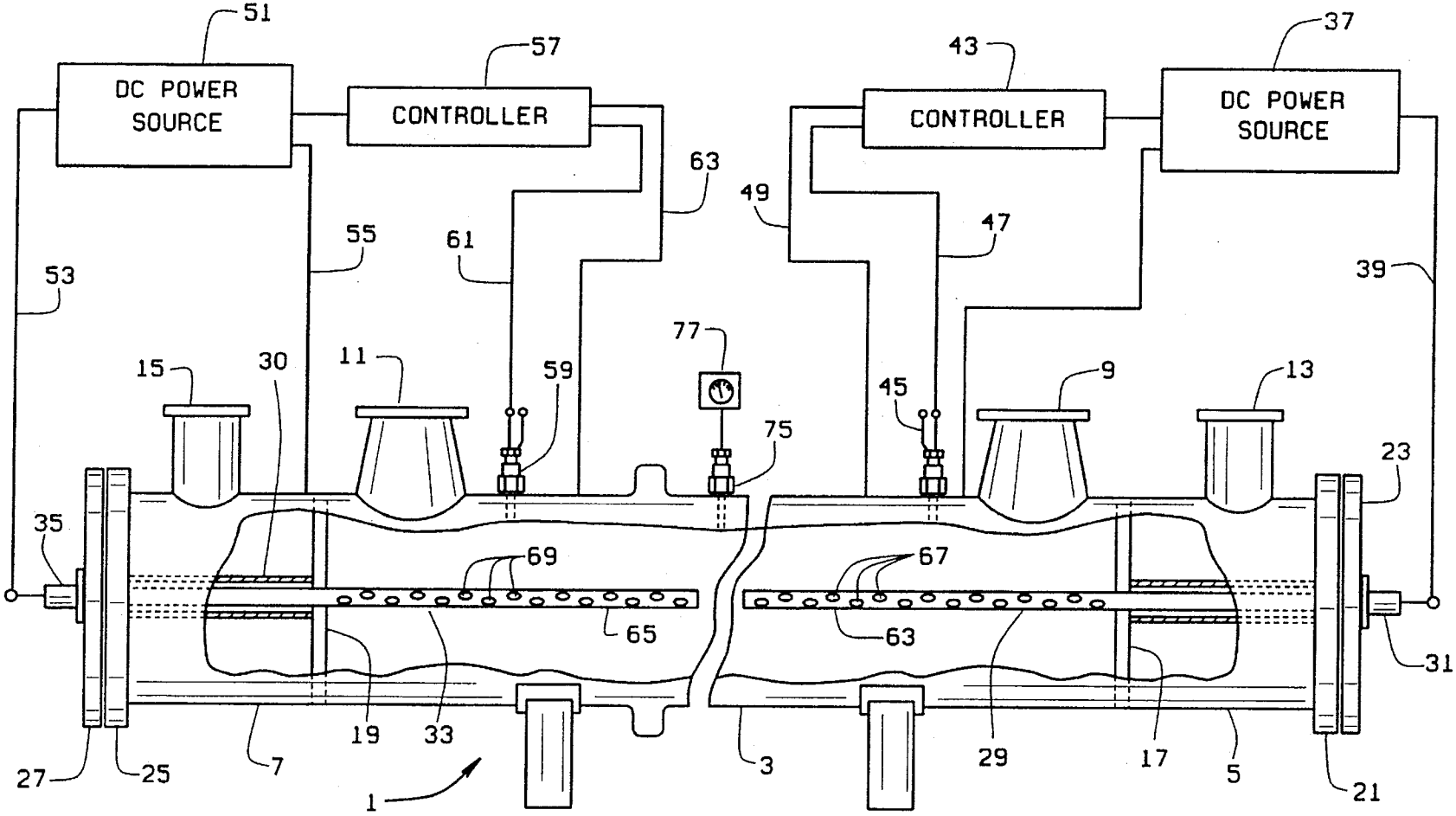
FIG. 1 is a schematic illustration of a shell and tube heat exchanger of the invention showing one embodiment of the anodic projection circuit.

FIG. 1 illustrates a heat exchanger 1 comprising a shell 3, an inlet head 5, and a outlet head 7. A corrosive liquid such as sulfuric acid flows through the shell, entering through a nozzle 9 and exiting through a nozzle 11. Baffling within the shell side of the exchanger directs the flow in such fashion as to maximize contact time, turbulence, heat transfer, and establish a longitudinal temperature gradient in the exchanger, preferably an essentially monotonic gradient in which the temperature falls progressively from the hot end in the region of nozzle 9 to the cold end in the region of nozzle 11. Cooling water enters the exchanger through a nozzle 13 in head 5 and exits through a nozzle 15 in head 7. The water passes through tubes, which are not shown in the drawing but which extend from a tube sheet 17 at the hot end of the exchanger to a tube sheet 19 at the cold end. These tube sheets divide the shell 3 of the exchanger from the heads 5 and 7, respectively.

Head 5 has a flange 21 at its outer end and is closed by a blank flange 23 attached to flange 21. Similarly, a flange 25 at the outer end of exit head 7 is closed by a blank flange 27.

The tubes are constructed of a material, such as stainless steel, which is subject to anodic protection. Advantageously, the shell and other parts wetted by the corrosive liquid, for example, tube sheet, baffles, tie rods, etc., are constructed of the same material so that corrosion of these components may also be prevented by operation of the anodic protection system.

A first elongate cathode 29 extends through inlet head 5 and tube sheet 17 and further for a substantial distance within shell 3 in an orientation parallel to the tubes of the exchanger. Within head 5, the cathode passes through a cathode entry pipe 28, which extends from tube sheet 17 through flange 23. A nozzle 31 in blank flange 23 provides a channel of communication for connection between cathode 29 and the negative terminal of a first direct current power source. Similarly, a second elongate cathode 33 extends through exit head 7 (via a cathode entry pipe 30 extending from tube sheet 19 through blank flange 27), tube sheet 19, and for a substantial distance from tube sheet 19 into shell 3, thereby providing a channel for connection between the second cathode and the negative terminal of a second direct current power source.

Each power source is part of an anodic protection circuit for the tubes in the end of the heat exchanger in which the cathode to which it connects is located. The negative terminal of first dc power source 37 is in electrical communication with cathode 29 via a transmission line 39 and the positive terminal of power source 37 is in electrical communication with shell 3 via a transmission line 41. Although it is not feasible to connect the voltage source directly to the tubes of the heat exchanger, connection to the shell provides a means of electrical communication between the positive terminal and the tubes via the tube sheet, which is in electrical contact with both shell and tubes.

The voltage output of power source 37 is controlled by a controller 43 in response to the measured potential difference between the shell and a reference electrode 45 immersed in the corrosive liquid within the shell adjacent the tubes and cathode 29. Reference electrode 45 is in communication with the controller via signal line 47 and the shell is in electrical communication with controller via signal line 49. The reference electrode and signal lines comprise conventional means for detecting the voltage at the metal surface to be anodically protected, in this instance the exterior surface of the tube walls. Where the shell arid/or other wetted parts, such as baffles, tie rods, and the like, are constructed of a metal subject to anodic protection, the voltage of these parts is essentially the same as adjacent portions of the tubes, and is also sensed by the voltage detecting means. The controller establishes the desired positive voltage at the tube wall (and other wetted part) surfaces by controlling the voltage output of the power source in response to the surface voltage detecting means.

The second anodic protective circuit, which protects the cold end of the exchanger containing cathode 33, is arranged and operates in the same manner as the first anodic protection circuit. This second circuit includes a second direct current power source 51 whose negative terminal is electrically connected to cathode 33 via a transmission line 53. The positive terminal of power source 51 is electrically connected to the shell of the exchanger via a transmission line 55. The voltage output power source 51 is controlled by a controller 57 which is in electrical communication with a reference electrode 59 via a signal line 61 and in electrical communication with the shell via a signal line 63.

Preferably, each of cathodes 29 and 33 is covered with a sheath of non-conductive material 63, 65 which prevents grounding of the cathode on baffles and the respective tube sheets. The sheath is preferably constructed of thermoplastic material, such as Teflon. In the embodiment illustrated in FIG. 1, the sheath extends into the tube sheet to positively insulate the cathode from the tube sheet in this region. Holes 67, 69 in the non-conductive sheath provide for electrical contact between the corrosive liquid in the shell and the conductive surfaces of the cathode rods. These holes are located so as to prevent short-circuiting between the cathode rod and either tube sheet or baffles and may be sized and spaced to provide the desired current density in the anodic protection circuit. By means of physical spacing of the cathodes and/or location of the holes in the insulating sheath, the conductive surface of the second cathode in contact with the corrosive liquid is spaced sufficiently from the conductive surface of the first cathode in contact with the corrosive liquid so that the operation of the two circuits do not interfere with one another. Preferably, the shortest distance between points on the first and second cathodes that are both in contact with the corrosive liquid is at least about equal to the diameter of the shell.

In the embodiment illustrated in FIG. 1, the cathode is mechanically supported on the baffles and the tube sheet. In an alternative embodiment of the invention, the cathode may be supported on rods, hangers, or brackets attached to the baffles or the shell itself. Advantageously, such cathode support means comprise an insulating material. In any case, it is convenient, but not essential for the sheath to extend along the entire length of the cathode. Sheathing or other form of insulation must be provided, however, at the points of support where the cathode could otherwise be shorted to the baffles or the shell.

FIG. 1 illustrates an embodiment in which each cathode is cantilevered from the tube sheet at the end of the exchanger that is to be protected by the anodic circuit of which it is a part. Thus, cathode 29 is in electrical contact with the corrosive liquid in a first zone of the shell between tube sheet 17 and a location spaced from tube sheet 19 at the other end of the shell. Within this zone cathode 29 extends parallel to and is spaced laterally from the tubes. Similarly, cathode 33 is in electrical contact with the corrosive liquid in a second zone extending from tube sheet 19 to a location spaced from tube sheet 17 and extends parallel to and is spaced laterally from the tubes in the latter zone.

Those skilled in the art will recognize that the each of the zones of electrical contact extends from a location that is very near the tube sheet from which the cathode of that zone extends, and at which the corrosive liquid is essentially at its inlet (or outlet) temperature, but which is sufficiently separated from the tube sheet to prevent short circuiting between the tube sheet and the cathode. This is accomplished by spacing the nearest holes in the sheath an appropriate distance from the face of the tube sheet. Alternatively, a non-conductive liner may be provided for the tube sheet, in which case, the zone of electrical contact may extend essentially from the face of the liner. The other end of the zone of electrical contact is ordinarily spaced a substantial distance from the opposite tube sheet, typically by at least about one half the length of the exchanger shell. However, in anodic protection of heat exchangers for-exposure to corrosive liquids such as sulfuric acid, the electrical contact zone on the hot end may extend less than half the length of the shell, for example, in the range of about one third of that length, and the electrical contact zone on the cold end may extend for more than half the length of the shell, for example, in the range of about two thirds thereof.

In operation of the system, the voltage set point of each of controllers 43 and 57 is set independently of the other in order to provide optimal anodic protection at each end of the exchanger. Thus, the set point of each controller is selected to maintain the voltage profile along the tubes within the passive range in the entire zone that is governed by that controller.

A third reference electrode 75 detects the voltage in the region between the two cathodes. A signal from electrode 75 is transmitted to a readout device 77 so that the operator can observe any conditions that may fall outside bile passive range in the aforesaid region, and make any indicated adjustment in the set points of the controllers to avoid a corrosive condition in that region.

In the embodiment of FIG. 1, the cathode which is exposed to contact with the corrosive liquid only in the cold end of the exchanger ordinarily suffers minimal corrosion and can be expected to survive essentially the entire life of the heat exchanger. Only the cathode which is exposed to contact with the corrosive liquid at the hot end will ordinarily suffer corrosion sufficient to require its replacement at any frequent interval.

Figure 2:
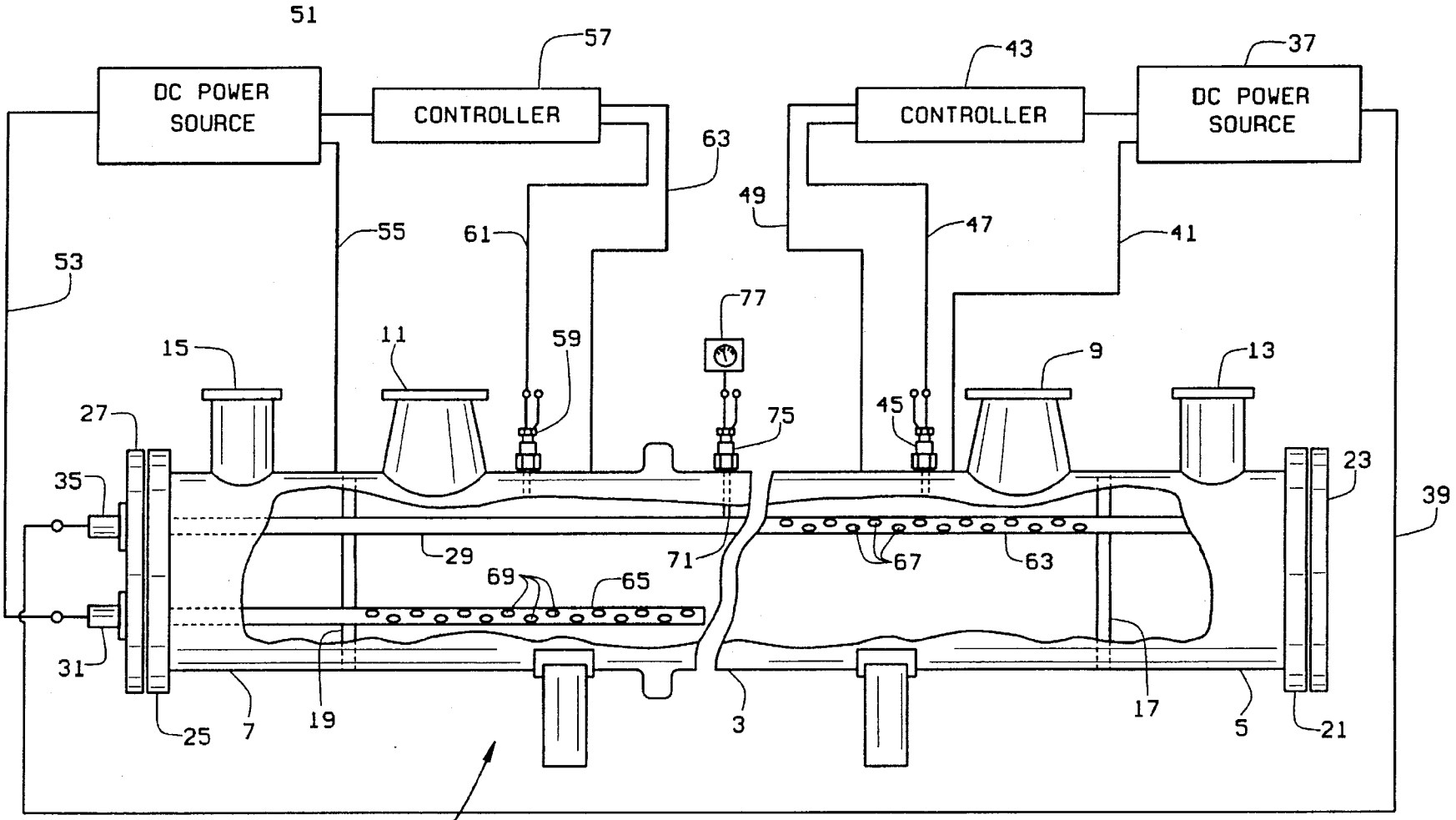
FIG. 2 is a schematic illustration of an alternative embodiment of the anodically protected heat exchanger of the invention; arid

FIG. 2 illustrates an alternative embodiment of the invention in which cathode 29 physically extends from one end of the exchanger to the other but, like the cathodes of FIG. 1, is in electrical contact with the corrosive liquid only in the same zone as the corresponding cathode of FIG. 1. In FIG. 2, cathode 29 is covered with a sheath of insulating material so that it is out of contact with the corrosive liquid in the general region of tube sheet 19. However, holes in the sheath provide electrical contact between the cathode and the corrosive liquid in a zone extending between tube sheet 17 and a location 71 that is substantially spaced from tube sheet 19. The embodiment of FIG. 2 is particularly advantageous where the exchanger is more accessible from one end than from the other, for example, where the exchanger is vertically oriented and inadequately elevated for cathode entry from the bottom end. In the embodiment of FIG. 2, cathode 33 is constructed in the same fashion as it is in FIG. 1. However, if desired, the latter cathode could also extend from tube sheet to tube sheet with holes being provided to allow electrical contact between the cathode surface and the corrosive liquid only in the zone between tube sheet 19 and location 73 spaced substantially from tube sheet 17.

In the embodiment of FIG. 2, it is preferred that the cathode which extends to both ends of the exchanger be exposed to contact with acid in the cold end only. If only the shorter cathode is exposed to hot acid, it will be the only cathode which needs to be replaced with any frequency due to cathode corrosion. Replacement of this cathode is more economical because it is shorter and, therefore, less expensive.

Cathodes 29 and 33 are comprised of a material of construction which is resistant as economically feasible to corrosion in the corrosive liquid under the conditions of operation of the heat exchanger. Although the entire cathode may thus be constructed of such materials as high nickel alloys, these materials have relatively high resistivity. Consequently, if the entire cross-section of the cathode rod is constructed of such materials, voltage drop in the rod may be substantial at certain of the current levels encountered in anodic protection, resulting in a voltage gradient that may force a portion of the tubes outside the passive range even using the independent anodic protection circuits of the invention. Preferably, therefore, the cathodes are of composite construction comprising a tubular outer portion of highly corrosion resistant material, having an inner wall in electrical communication with a more conductive core rod, and an outer wall exposed to the corrosive liquid. The core rod is constituted of conductive material such as aluminum, copper, or, preferably, stainless steels, for example, types 304 and 316 stainless steels. The cathode rod may be fabricated by drawing a tube of the corrosion resistant material over a copper, aluminum, or stainless steel core.

Figure 3:
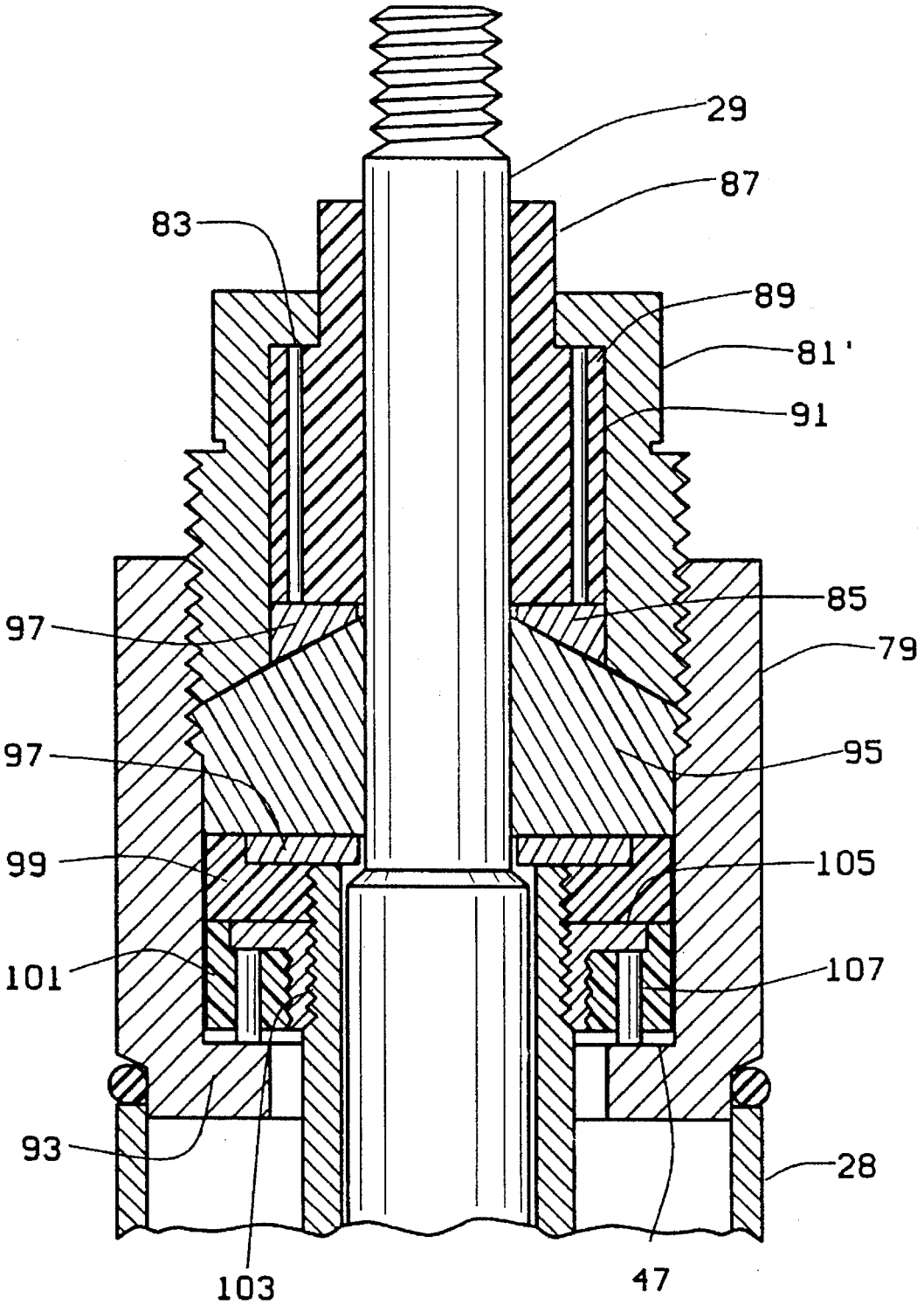
FIG. 3 illustrates the seal construction for the point at which the cathode extends through the tube sheet.

Illustrated in FIG. 3 is a preferred seal construction for the point of entry of the cathode through the flanges 23 and 27 into heads 7 and 5, respectively, and through the tube sheet into the shell. The sealing means serves a dual function: first to prevent leakage of liquid; and secondly, to insulate the cathode rod from the tube sheet and the shell. The sealing means comprises a stuffing box 79 welded to pipe 28 extending from the tube sheet at the cathode point of entry. The outer end of the stuffing box is internally threaded for attachment of an externally threaded packing gland 81. At its outer end, packing gland 81 has a flange 83 extending radially inwardly towards rod 29. An annular bushing 85, which may be constructed of metal, is positioned within the inner end of the packing gland, surrounding but spaced from rod 29. A tubular sheath 87 of insulating material, preferably a thermoplastic material such as polytetrafluroethylene, surrounds the cathode rod within packing gland 81 between flange 83 and bushing 85. The annular edge of the inner end of the sheath bears on the outer face of bushing 85 and an annular shoulder 89 of the sheath bears on the innerface of flange 83. Within the tubular walls of sheath 87 are a plurality of pins 91 extending longitudinally from the annular edge of the inkier end of the sheath to flange 83. Pins 91 are generally parallel to the cathode rod and are arrayed circumferentially along a radius greater than the inside radius of either flange 83 or bushing 85. Pins 91 comprise stiffening means which limit deformation of plastic sheath 87 by tightening forces applied to the packing gland. As the packing gland is tightened, as described below, the inner ends of the stiffening means are brought to bear on the bushing and the outer ends of the stiffening means bear on the flange, thereby resisting further compression of the tubular sheath.

Stuffing box 79 further comprises a flange 93 extending radially inwardly toward rod 29 axially inward of packing gland 81. Between packing gland 81 and flange 93 are packing 95, a metal washer 97, all insulating washer 99, and a thermoplastic bushing 101. Bushing 101 is internally threaded to receive a stainless steel externally threaded tubular insert 103, the insert being threaded both externally and internally. The outer face of bushing 101 is recessed (counterbored) to receive a flange 105 on the outer end of insert 103. Preferably, the packing, washer 99 and bushing 101 are all constituted of polytetrafluroethylene.

Within the tubular wall of bushing 101 are pins 107 extending from the outer face of flange 93 to the interface of flange 105. Pins 107 comprise stiffening means which limit deformation of bushing 101 by tightening forces applied via the packing gland.

Washer 97 surrounds cathode rod 29 but is spaced therefrom. The outer face of washer 99 is recessed (counterbored)

to receive washer 97, the outside diameter of the latter being smaller than the inside diameter of the stuffing box, and insulated from the stuffing box by the wall of the recess in the outer face of washer 99.

The outer end of sheath 63 is externally threaded for engagement with the internal threads of insert 103 within bushing 101. Sheath 63 is screwed into insert 103 until the outer annular rim of the sheath bears on the inner face of washer 99. Tightening of packing gland 81 compresses packing 95, causing the packing to bear on the inner face of bushing 85 and bushing 101 to bear on the outer face of flange 93.

Preferably, the shell, tube sheets, and baffles within the shell are also constructed of a metal which is passive to corrosion in the corrosive liquid within a range of positive voltage. Where this is the case, the anodic protection circuits are effective to protect these components as well. The circuits are arranged so that the shell is in electrical communication with the positive terminal of the first power source within the aforesaid first zone of electrical contact with the corrosive liquid, and in electrical communication with the positive terminal of the second power source in the second zone. The tube sheet at the end of each zone and baffles within each zone are also in electrical communication with the positive terminal of the power source for that zone. Thus, the voltage profile along the interior surface of the shell is the same as the profile along the exterior surfaces of the tubes, the voltage on the surface of each baffle is substantially the same as the voltage of the tubes which its supports, or which are adjacent to it, and the voltage at the surface of the tube sheet is the same as the voltage of the tubes at the tube sheet. The voltage output of each power source is controlled to maintain the interior surfaces of the shell, the surfaces of the tube sheet, and the surfaces of the baffles, within the passive range.

The system of the invention is advantageously utilized to anodically protect a stainless steel heat exchanger for cooling sulfuric acids such as absorption acid from the contact sulfuric acid manufacturing process. Sulfur trioxide produced in the contact process is absorbed in a circulating stream of concentrated sulfuric acid, thereby generating additional acid and a substantial amount of absorption heat. Net acid production is drawn off, and the acid is diluted with makeup water and recirculated to the absorber for further absorption of sulfur trioxide. Before recirculation, the acid stream must be cooled to remove the absorption heat. Stainless steel coolers have been used for this purpose, but are subject to relatively rapid corrosion, especially where the circulating acid is maintained at high temperature for other process objectives. Anodic protection in accordance with the invention substantially enhances the serviceability of stainless steel heat exchangers for this and other high temperature acid applications.

Although described and discussed above with regard to cooling hot sulfuric acid, the anodically protected exchanger of the invention may also be used in applications wherein corrosive liquids are heated to elevated temperature, for example, for use as reagents in chemical reaction systems.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. In an anodically protected heat exchanger for a corrosive liquid, said heat exchanger having an elongate shell, a plurality of elongate tubes extending longitudinally within said shall and constructed of a metal which is passive to corrosion by said liquid within a range of positive voltage at the metal surface, said corrosive liquid flowing through the shell side of said exchanger and a heat transfer fluid flowing within said tubes for exchanging heat with the corrosive liquid, and baffle means within said shell to direct the flow of said corrosive liquid in a path within said shell such that there is a longitudinal temperature gradient in the corrosive liquid on the shell side of the exchanger, the fluid nearest one end of the elongate shell being at a higher temperature than the fluid at the other end of the shell, an improved anodic protection system for protecting the exterior surfaces of said tubes against corrosion by said corrosive liquid, said anodic protection system comprising:

a first anodic protection circuit comprising a first direct current voltage source, means for electrical communication between the positive terminal of said first source and said tubes at one end of said shell,i a first elongate cathode contained within said shell, said first cathode extending parallel to said tubes and spaced literally therefrom, said cathode being in electrical contract with said corrosive liquid in a first zone of said shell between the tube sheet at said one end of the shell and a location spaced from the tube sheet at the other end of said shell, means for electrical communication between said first cathode and the negative terminal of said first voltage source, means for detecting the voltage at the exterior surfaces of said tubes within said first zone, and means for controlling the voltage output of said first power source in response to said first detecting means so that the voltage at the exterior surfaces of said tubes in said first zone is controlled at a voltage at which said metal is passive to corrosion by said liquid;

a second anodic protection circuit comprising a second direct current voltage source, means for electrical communication between the positive terminal of said second source and said tubes at the end of said shell opposite said first end, a second elongate cathode contained within said shell, said second cathode extending parallel to said tubes and spaced laterally therefrom, said cathode being in electrical contract with said corrosive liquid in a second zone of said shell between the tube sheet at said other end of the shell and a location spaced from the tube sheet at said one end of said shell, means for electrical communication between said second cathode and the negative terminal of said second voltage source, means for detecting the voltage at the exterior surfaces of said tubes within said second zone, and means for controlling the voltage output of said second power source in response to said means for detecting the voltage at said exterior surfaces within said second zone so that the voltage at the exterior surfaces of said tubes in said second zone is controlled at a voltage at which said metal is passive to corrosion by said liquid;

the conductive surfaces of said second cathode in contact with said corrosive liquid being spaced sufficiently from the conductive surface of said first cathode in contact with said corrosive liquid so that the operations of said circuits do not interfere with one another;

neither of the zones within which said cathodes are in electrical contract with said corrosive liquid extending longitudinally beyond the maximum length over which the voltage source may be adjusted to control the voltage at the exterior surfaces of the tubes in that zone within the passive range;

any portion of either cathode that extends beyond said maximum length being covered with a sheath of non-conductive material, thereby preventing electrical contact between the cathode and said corrosive liquid at points beyond said length.

2. An improved anodically protected heat exchanger as set forth in claim 1 having a sheath of non-conductive material covering each cathode over its entire length, said sheath having holes therein for electrical contact between said corrosive liquid and said cathode within said zone.

3. An improved anodically protected heat exchanger as set forth in claim 2 wherein at leas tone of said cathode extends longitudinally throughout said shell and is electrically connected at one of its ends to the negative terminal of said direct current power source.

* * * * *

UNITED STATES PATENT AND TRADEMARK OFFICE

CERTIFICATE OF CORRECTION

PATENT NO. : 5,515,913
DATED : May 14, 1996
INVENTOR(S) : Delio Sanz it is certified that error appears in the above-indentified patent and that said Letters Patent is hereby corrected as shown below:

Col. 10,
Claim 1, line 21 "shell, i a" should be -- shell, a --; and

Signed and Sealed this

Fourteenth Day of January, 1997

Bruce Lehman

*Attest:*

BRUCE LEHMAN

*Attesting Officer*

*Commissioner of Patents and Trademarks*